US006260742B1

(12) United States Patent
Caillaud et al.

(10) Patent No.: US 6,260,742 B1
(45) Date of Patent: Jul. 17, 2001

(54) POURING SPOUT FOR A CONTINUOUS-CASTING MOLD

(75) Inventors: Frederic Caillaud, Faubeuge; Johan Richaud, Feignies, both of (FR); Eric Hanse, Dour (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/497,722

(22) Filed: Feb. 4, 2000

(51) Int. Cl.[7] ..... B22D 41/50
(52) U.S. Cl. ..... 222/594; 222/606
(58) Field of Search ..... 222/594, 606, 222/607, 590

(56) References Cited

U.S. PATENT DOCUMENTS

| | | | | |
|---|---|---|---|---|
| 3,395,831 | * | 8/1968 | Minteer, Jr. | 222/606 |
| 4,776,502 | | 10/1988 | Hagenburger et al. . | |
| 5,733,469 | | 3/1998 | Damasse et al. . | |

FOREIGN PATENT DOCUMENTS

| | | |
|---|---|---|
| 1017923 | 9/1977 | (CA) . |
| 492231 | 12/1991 | (EP) . |
| 1295169 | 10/1970 | (GB) . |

* cited by examiner

*Primary Examiner*—Scott Kastler
(74) *Attorney, Agent, or Firm*—James R. Williams

(57) ABSTRACT

The invention concerns a pouring spout for the transfer of a molten metal from a tundish into a continuous-casting mold. The pouring spout includes a body comprising a tubular part defining an essentially vertical pouring channel and an essentially horizontal part defining a distribution channel. The tubular and horizontal parts are assembled together, notably by screwing. The vertical pouring channel has an upper end adapted to connect with a tundish and a lower end emptying into the distribution channel. The distribution channel includes at least two outlets adapted to distribute molten metal into the mold. An obstacle is located between the two channels and together with the lower part of the tubular part retains the molten metal in the pouring channel until transfer to the distribution channel.

6 Claims, 1 Drawing Sheet

POURING SPOUT FOR A CONTINUOUS-CASTING MOLD

The present invention concerns a pouring spout for the transfer of a molten metal from a distributor into a continuous casting ingot mold, comprised of a body made up of a tubular part that delimits an essentially vertical pouring channel, and an essentially horizontal part that delimits a distribution channel, these two parts being assembled to each other, notably by being screwed together, the pouring channel having an upper end designed to be connected to the distributor and a lower end emptying into the distribution channel, the latter having at least two orifices emptying into the continuous-casting ingot mold, an obstacle being placed in the casting channel.

In the continuous casting of steel it is desirable for a number of reasons to assure a tranquil and regular flow of the metal into the ingot mold.

This is why a pouring spout of the above type was conceived (FR 2 739 313); it has an obstacle in the path with the molten metal that is designed to induce a deficiency in charging the stream of steel and thus to slow down this stream.

Such an arrangement presents numerous advantages. It reduces the cross section locally available for the passage of the molten metal. This has the effect of slowing down the rate of flow and improving the inner filling of the spout. The flow is thus rendered more regular. The symmetry of the flows in the right and left halves of the ingot mold and the regularity in time are notably improved.

However, this spout has a shortcoming. It is comprised of a tubular part at the lower end of which a hollow part, essentially in the form of an inverted T, is screwed. A perforated piece, which constitutes the obstacle for obtaining a charge deficiency placed in the path of the molten metal, is inserted between a shoulder or collar of the inverted T part and the lower end of the tubular part. Due to the improvement in internal filling, a quantity of steel accumulates above the perforated piece that forms the obstacle.

The thread that assembles the tubular part and the part in the form of an inverted T is then subjected to ferrostatic pressure. Since the threads are not tight, leaks are observed at its level. Even the addition of cement does not make the thread tight.

The object of the present invention is a spout that remedies this disadvantage. According to the invention, the spout has means for tightly retaining the molten metal upstream from the obstacle.

According to a first embodiment, the obstacle is formed in a single piece with the tubular part. Consequently, the joint is eliminated and the leaks are thus suppressed. According to a preferred embodiment, the part of the pouring channel located above the obstacle has a lining of a material different from that of the tubular part.

The obstacle can be made of the same material as the body or of a material different from the body.

According to a variant, the tight means of retention are comprised of a lining inserted into the pouring channel and integrating the obstacle. This lining should of course extend sufficiently high in the pouring charnel so its edges are above the maximum level of molten metal.

According to a preferred variant, the insert having a smaller obstacle of passage than the diameter of the pouring channel is provided in the upper part of the body.

Other characteristics and advantages of the present invention will be manifested in reading the following description with reference to the attached Figures.

Figure 1:
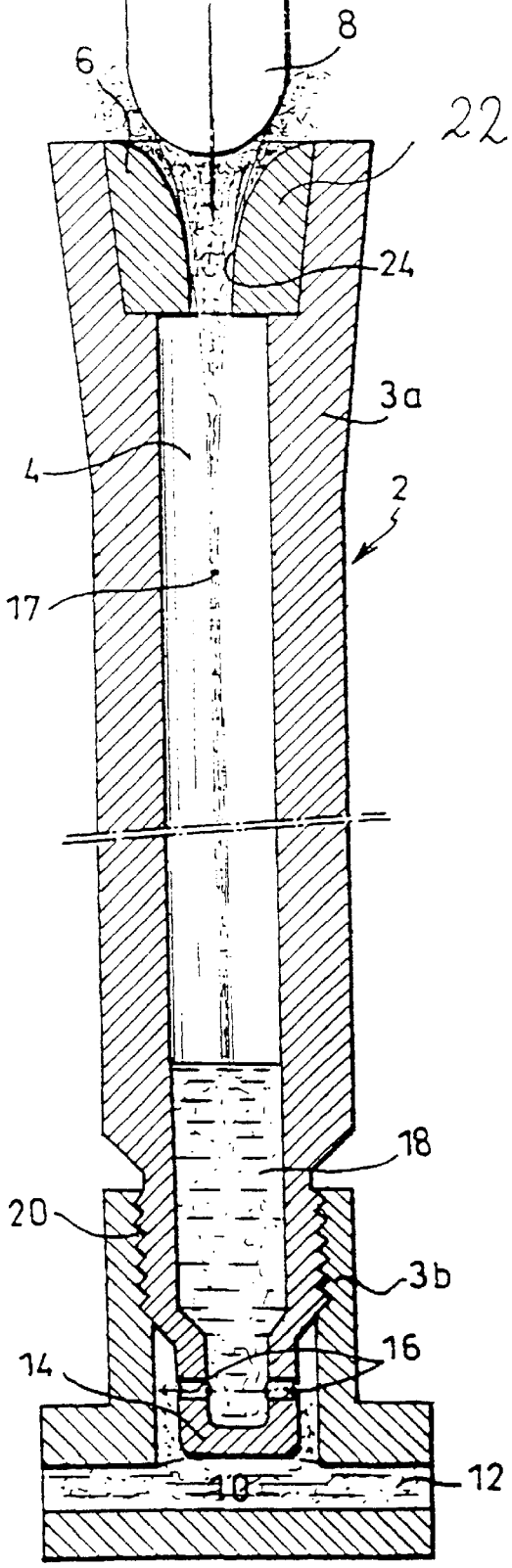
FIG. 1 is a cross-sectional view of a first mode of implementing the invention.

In FIG. 1 the general reference 2 designates the spout of the invention. Its body is comprised of two parts: an upper tubular part 3*a* and a lower part 3*b* in the form of an inverted 'T'. These two parts are assembled together by a thread 20 in the example shown.

Part 3*a* delimits a vertical pouring channel 4. The upper end of the channel has a seat 6 for a stopper rod 8. This seat is constituted by an insert 22 produced separately and maximized in a recess of the body of the spout. This insert has a hole 24 whose diameter is definitely smaller than that of the pouring channel 4. The channel 4 empties at its lower end into a distribution channel 10 essentialy perpendicular to the channel 4. The channel 10 has at least two outlets 12 through which the molten metal flowers into the ingot mold. Other outlets may also be provided. An obstacle 14 is provided at the lower part of the pouring channel 4. This obstacle 14 can assume different forms. In the embodiment example shown it is comprised of a tube with a diameter smaller than that of the pouring channel 4. This tube has orifices 16 perpendicual to the wall of the channel 4. The obstacle 14 brakes the flow of the stream of steel 17 that the stopper rod 8 allows to pass. A certain amount of molten metal 18 accumulates above the obstacle 14. According to the invention, the obstacle 14 is in one piece with the tubular part 3*a*. In other words, these two elements form an integral component, produced in a single operation of isostatic pressing. There is thus no joint between the obstacle 14 and the tubular part 3*a*. Leaks are thus suppresed.

On the other hand, due to the substantial difference between the cross section of the hole 24 and that of the channel 4, substantial variation will be noted in the flow rate at the level of the stopper rod, which is expressed by a relatively slight variation in the height of the molten metal 18 above the obstacle, which helps to maintain the stability of flow in the ingot mold.

In the example shown, the tubular part 3*a* is of a single material. Two or more different materials, compressed in one or more operations can also be used. The obstacle 14 can be of a different material than that of the tubular part proper. Or an internal lining of a material more resistant to erosion than that of the body 3 can also be provided in the pouring channel 4. Finally, the obstacle 14 and the lining can be of the same material but different than that of the body. But the obstacle 14 and the tubular part 3*a* are still in one piece even in these cases.

Figure 2:
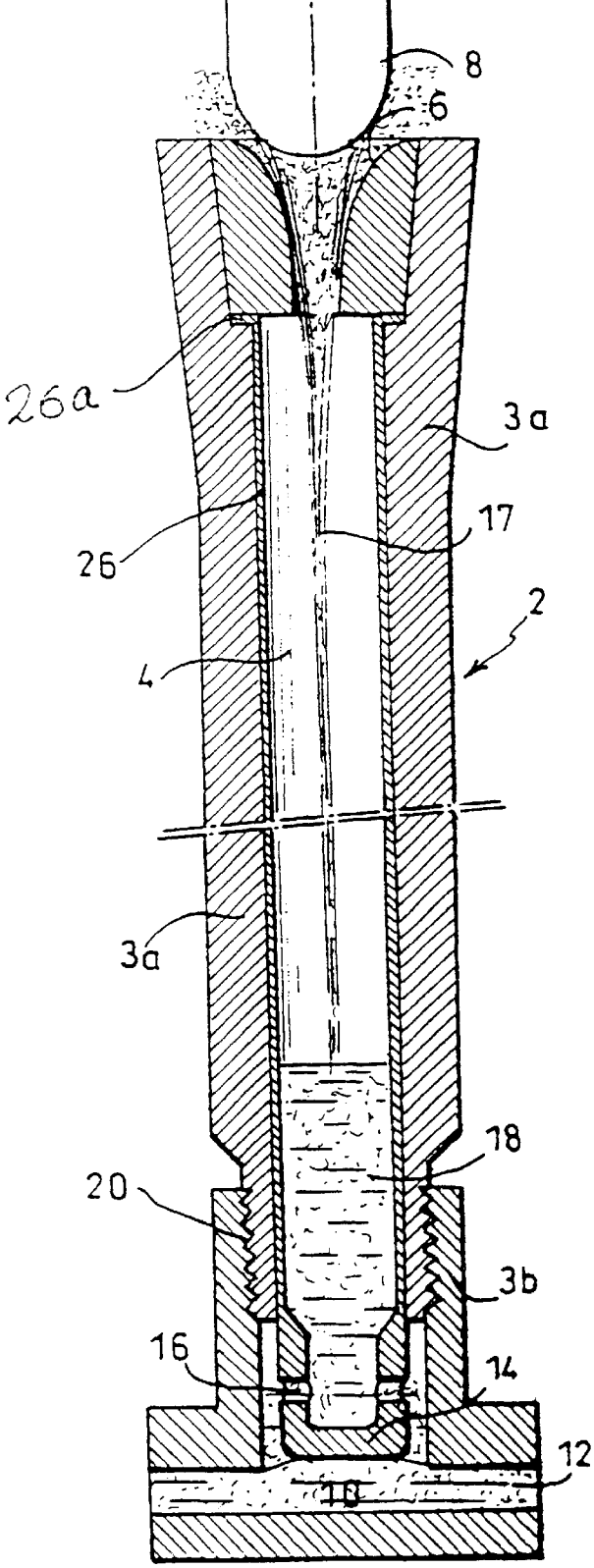
FIG. 2 is a cross-sectional view of a second mode of implementation of the invention.

FIG. 2 shows another embodiment variant of the invention spout. The obstacle 14 is constituted of a jacket 26 produced separately from the body of the spout and which is terminated at its lower end by a tube 14 of smaller diameter, identical to that of FIG. 1. This jacket or lining is inserted into the pouring channel 4. It is retained at its upper part by a collar 26*a* that rests on a shoulder of the tubular part 3*a*. Its edge is clearly above the level of the molten metal 18. Leaks are thus impossible. As a variant, the lining 26 could be supported by its lower end on a shoulder of the tubular part 3*a*.

Other modes of actualizing the tightly sealed retention means could be envisioned without departing from the scope of the invention. It could thus be possible to provide a spout in two assembled parts involving an obstacle 14 constituting a seperate piece, the edge of which does not rise above the level of the molten metal 18, but in which the cylindrical part of the part 3*b* would be prolonged upward so as to go beyond the level of the molten metal.

What is claimed is:

1. A pouring spout for the transfer of molten metal from a distributor into a continuous-casting mold, comprising:

a tubular part having a body portion, an upstream end adapted to be connected to the distributor, a downstream end, and a first inner surface that delimits a pouring channel between the upstream and downstream ends;

a horizontal part screwed to the downstream end and having a second inner surface that delimits a distribution channel, the distribution channel essentially perpendicular to and fluidly connected to the pouring channel, the distribution channel having at least two outlets permitting molten metal to empty into the mold; and an obstacle located between the pouring channel and the distribution channel, the obstacle and first inner surface retaining the molten metal within the pouring channel until the molten metal flows into the distribution channel.

2. The pouring spout of claim 1, wherein a single piece comprises the tubular part and the obstacle.

3. The pouring spout of claim 1, wherein the body and the first inner surface comprise different materials.

4. The pouring spout of claim 1, wherein the tubular part and the obstacle comprise different materials.

5. The pouring spout of claim 1, wherein molten metal is retained within the pouring channel by an integration of the first inner surface and the obstacle.

6. The pouring spout of claim 1, wherein the pouring spout further comprises an insert at the upstream end defining an orifice with a diameter smaller than a diameter of the pouring channel.

* * * * *